US006502420B2

(12) United States Patent
Gupte

(10) Patent No.: US 6,502,420 B2
(45) Date of Patent: Jan. 7, 2003

(54) PLATE HEAT EXCHANGER FOR MULTIPLE CIRCUIT REFRIGERATION SYSTEM

(75) Inventor: Neelkanth Shridhar Gupte, Liverpool, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/871,181

(22) Filed: May 31, 2001

(65) Prior Publication Data

US 2002/0178746 A1 Dec. 5, 2002

(51) Int. Cl.[7] ..... F25B 41/00
(52) U.S. Cl. ..... 62/513; 165/140
(58) Field of Search ..... 62/513, 506, 507; 165/140, 166, 167

(56) References Cited

U.S. PATENT DOCUMENTS 2,937,856 A * 5/1960 Thomson ..... 165/167
3,150,028 A * 9/1964 Wennerberg ..... 165/167
4,282,927 A * 8/1981 Simmons ..... 165/166
5,180,004 A * 1/1993 Nguyen ..... 165/135
5,462,113 A * 10/1995 Wand ..... 165/140
5,720,341 A * 2/1998 Watanabe et al. ..... 165/135
5,927,396 A * 7/1999 Damsohn et al. ..... 165/40
6,044,902 A * 4/2000 Pahade et al. ..... 165/140
6,237,358 B1 * 5/2001 Kondo et al. ..... 62/335

* cited by examiner

*Primary Examiner*—William E. Tapolcal
*Assistant Examiner*—Mohammad M. Ali
(74) *Attorney, Agent, or Firm*—Carlson Gaskey & Olds

(57) ABSTRACT

A multiple circuit plate heat exchanger exchanges heat between a heat transfer fluid and refrigerant. The first portion of the heat transfer fluid flow enters a first refrigerant circuit and exchanges heat with refrigerant in the first circuit. The second portion of the heat transfer fluid flow then enters a second refrigerant circuit and exchanges heat with refrigerant in the second circuit. By employing a single heat transfer fluid pass, the average leaving temperature difference from each circuit can be reduced, reducing entropy generation and making the system more thermodynamically efficient.

13 Claims, 5 Drawing Sheets

PLATE HEAT EXCHANGER FOR MULTIPLE CIRCUIT REFRIGERATION SYSTEM

BACKGROUND OF THE INVENTION

The present invention relates generally to a plate heat exchanger for a multiple circuit refrigeration system.

Heat exchangers, such as condensers and evaporators, are utilized in refrigeration cycles to exchange heat between a heat transfer fluid (e.g. water, brine or air) and a refrigerant. A single refrigerant circuit can be utilized in the refrigerant cycle. However, if the compressor needs service and is shut down, the refrigerant circuit cannot operate. Therefore, it is beneficial for two or more refrigerant circuits to be utilized. One refrigerant circuit may be switched off, allowing the other(s) to operate at full capacity or if service is required.

In a prior plate two pass heat exchanger, heat transfer fluid flows through alternate channels of the heat exchanger. In a heat exchanger having two refrigerant circuits, the refrigerant circuits are arranged so that all heat transfer channels exchange heat with both refrigerant circuits. At full load, both refrigerant circuits concurrently exchange heat with the entire heat transfer fluid flow. A drawback of the prior art is that heat exchanger is limited to a maximum of only two separate refrigerant circuits.

There are several drawbacks to the prior art plate heat exchangers for a multiple circuit refrigerant system. For one, when all of the refrigerant circuits are operating at a full load condition, the entropy generation (the destruction of availability) is high due to a relatively larger temperature differential between the heat transfer fluid and the refrigerant. Secondly, the difference between the saturated discharge temperature and the saturated suction temperature (temperature lift) is also high. The temperature lift is representative of the compression ratio and hence the compression power requirement.

Additionally, at part load condition, when one circuit is inactive, a significant portion of the liquid flow is not cooled in the inactive circuit. To meet the desired chilled liquid set point, the leaving liquid temperature from the active circuit needs to be significantly below the set point, placing an undue burden on the compressor and resulting in the loss of the coefficient of performance. When water is used as the heat transfer fluid, the leaving water temperature can approach the freezing temperature depending on the set point. The saturation temperature of the refrigerant may fall significantly below the freezing point temperature of the water, posing a threat of ice build up and failure of the heat exchanger.

Hence, there is a need in the art for an improved plate heat exchanger for a multiple circuit refrigeration system.

SUMMARY OF THE INVENTION

The present invention relates to a plate heat exchanger for a multiple circuit refrigeration system.

The plate heat exchanger of the present invention is formed from a plurality of alternating right plates and left plates adhered together by a method such as brazing, welding or gasket joints. The plates create a plurality of alternating heat transfer fluid flow channels and refrigerant flow channels. The heat transfer fluid flow channels pass through the entire length of the plate heat exchanger. In the preferred embodiment, the refrigerant flow channels include one or more seals located to create one or more separate refrigerant circuits. The heat transfer surface area of the refrigerant circuits are approximately proportional to the capacity of the compressor(s) connected to the circuits. For example, in a dual refrigerant circuit system, refrigerant from a first refrigerant circuit flows through the first portion of the refrigerant flow channels, and refrigerant from a second refrigerant circuit flows through the second portion of the refrigerant flow channels.

By employing a single heat transfer fluid circuit as described above, the average temperature difference between heat exchanging fluids can be reduced, reducing entropy generation and making the system more thermodynamically efficient. For the same amount of heat transfer area, the compressor power can be reduced significantly.

Accordingly, the present invention provides a plate heat exchanger for a multiple circuit refrigeration system.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
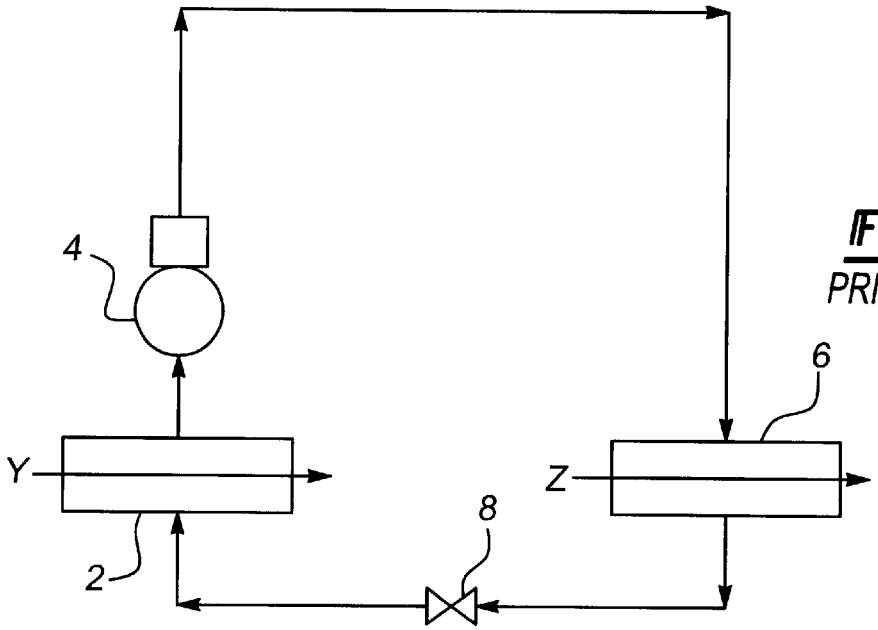
Fig-1 PRIOR ART
FIG. 1 illustrates a conventional prior art single refrigerant circuit refrigeration cycle.

FIG. 1 illustrates a conventional prior art single refrigerant circuit refrigeration cycle. Heat transfer fluid Y (e.g. water, brine or air) returning from application load is cooled in an evaporator 2, releasing heat to and evaporating the liquid refrigerant to form refrigerant vapor. The refrigerant vapor enters a compressor 4 and is compressed to a high pressure and a high temperature. The refrigerant then enters a condenser 6 and rejects heat to the heat transfer fluid Z. The refrigerant then enters the expansion valve 8, lowering both pressure and temperature and completing the cycle.

The saturation temperature of the refrigerant in the evaporator 2, the saturated suction temperature (SST), is less than the leaving temperature of the heat transfer fluid. The temperature of the refrigerant in the condenser 6, the saturated discharge temperature (SDT), is higher then the leaving temperature of the heat transfer fluid (or air if an air cooled condenser). The leaving temperature difference (LTD) is the difference between the leaving temperature of the heat transfer fluid and the refrigerant saturation temperature (either SST or SDT).

The difference between the saturated discharge temperature and the saturation suction temperature is defined as lift. Compression work is needed to increase the saturation temperature of the refrigerant from the saturated suction temperature to the saturated discharge temperature. The lower the lift, the lower the specific compressor work (i.e. work required per unit mass flow rate) required, and the higher the coefficient of performance, COP. The coefficient of performance is the ratio of useful power to the power input.

The present invention includes a plate heat exchanger employing a single heat transfer fluid circuit for the evaporator and liquid cooled condenser and at least two refrigerant circuits. In the preferred embodiment, two refrigerant circuits are employed.

Figure 2:
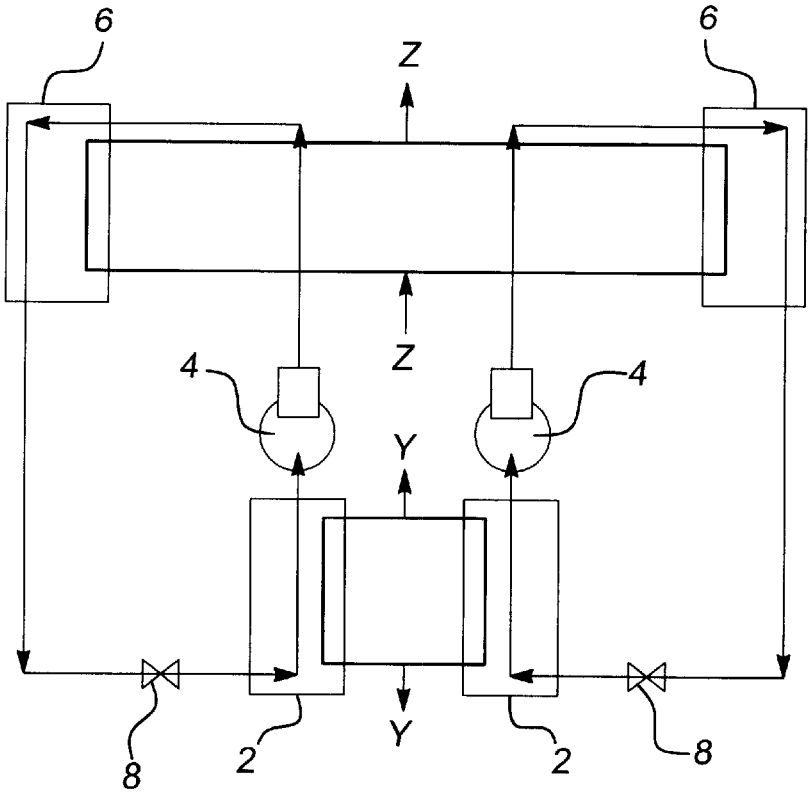
Fig-2 PRIOR ART
FIG. 2 illustrates a schematic diagram of a prior art plate heat exchanger.

FIG. 2 illustrates a schematic diagram of a prior art plate heat exchanger utilizing two refrigerant cycles. The following descriptions apply to evaporators 2. The design of the condensers 6 would be similar, except that the direction of the heat transfer flow and the refrigerant flows would be reversed.

Figure 3:
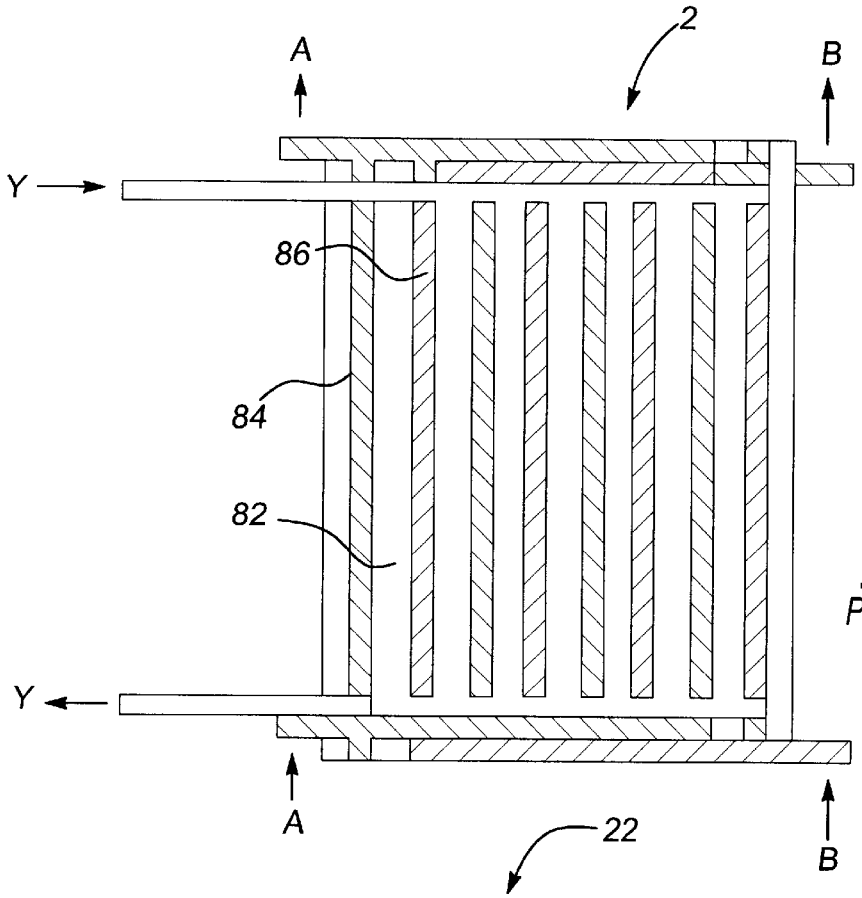
Fig-3 PRIOR ART
FIG. 3 illustrates a prior art plate heat exchanger.

An improved prior art plate heat exchanger utilizing two refrigerant circuits A and B is illustrated in FIG. 3. Heat transfer fluid circuit Y flows in alternating heat transfer fluid flow channel channels 82. Refrigerant from refrigerant circuit A flows through refrigerant flow channels 84, and refrigerant from refrigerant circuit B flows through refrigerant flow channels 86. Refrigerant circuit A and refrigerant circuit B are arranged such that every heat transfer fluid channel 82 (except for the first and the last) exchanges heat with both refrigerant circuits A and B. If one refrigerant circuit is deactivated, the entire heat transfer fluid flow exchanges heat with the active refrigerant circuit. At full load, this is equivalent to having one large heat exchanger with both refrigerant circuits A and B exchanging heat with the entire heat transfer fluid flow Y.

Figure 4:
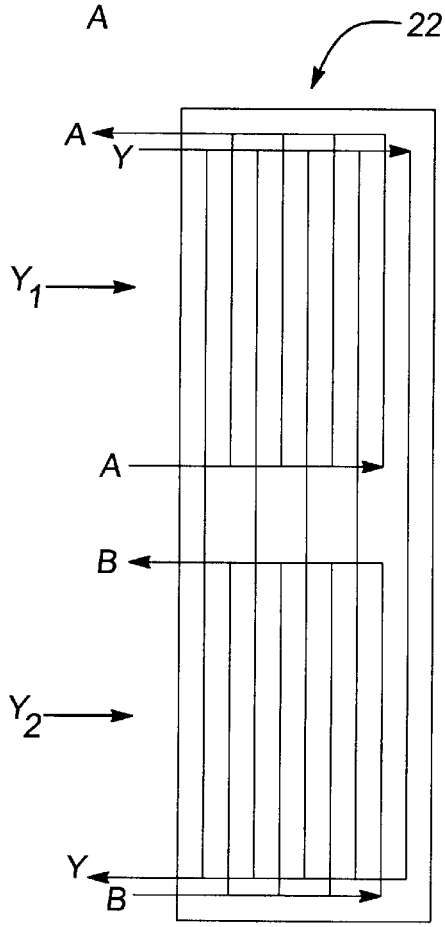
FIG. 4 illustrates a flow diagram of the plate heat exchanger of the present invention.

FIG. 4 illustrates a plate heat exchanger 22 of the present invention. An evaporator is illustrated and described, although the plate heat exchanger 22 could also be utilized in a condenser if the direction of the heat transfer fluid flow and the refrigerant circuit flow are reversed. Heat transfer fluid circuit Y flows into the plate heat exchanger 22. The first portion $Y_1$ of chilled heat transfer fluid circuit Y exchanges heat with the first refrigerant circuit A, and the second portion $Y_2$ of heat transfer fluid circuit Y exchanges heat with the second refrigerant circuit B.

Figure 5:
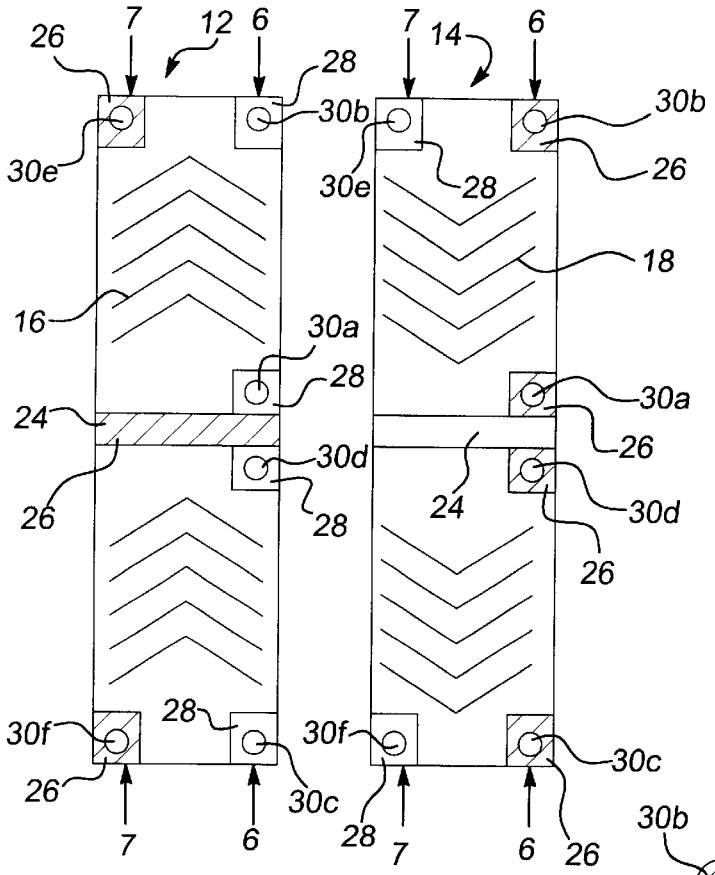
FIG. 5 illustrates a left plate and a right plate of the dual refrigerant circuit plate heat exchanger of the present invention.

The plate heat exchanger 22 is formed of a plurality of alternating left plates 12 and a right plates 14, as illustrated in FIG. 5. The left plate 12 includes a plurality of upside-down substantially "V-shaped" chevrons 16 each having a height. The right plate 14 includes a plurality of substantially "V-shaped" chevrons 18 also each having a height. The heights of the chevrons 16, 18 are substantially equal.

When alternating left plates 12 and right plates 14 are placed on top of each other, the chevrons 16, 18 form a plurality of flow channels 34. The plurality of chevrons 16, 18 extend along the entire length of the plates 12, 14, but are not formed in a centrally located circuit division 24. These locations are sealed by a method such as brazing, welding, or using a gasket. In a brazed plate heat exchanger, thin copper brazing sheets are placed between the plates 12, 14 and are melted in a vacuum furnace. Brazing occurs at the point of contact of the chevrons 16, 18.

Figure 6:
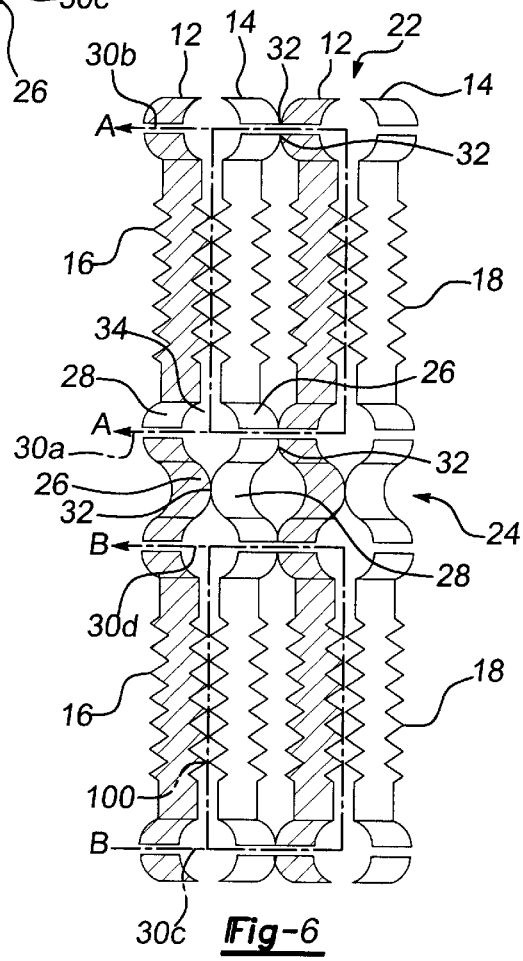
FIG. 6 illustrates a cross-sectional side view of the plate heat exchanger taken along line 6—6 of FIG. 5 showing the refrigerant circuit flow.
Figure 7:
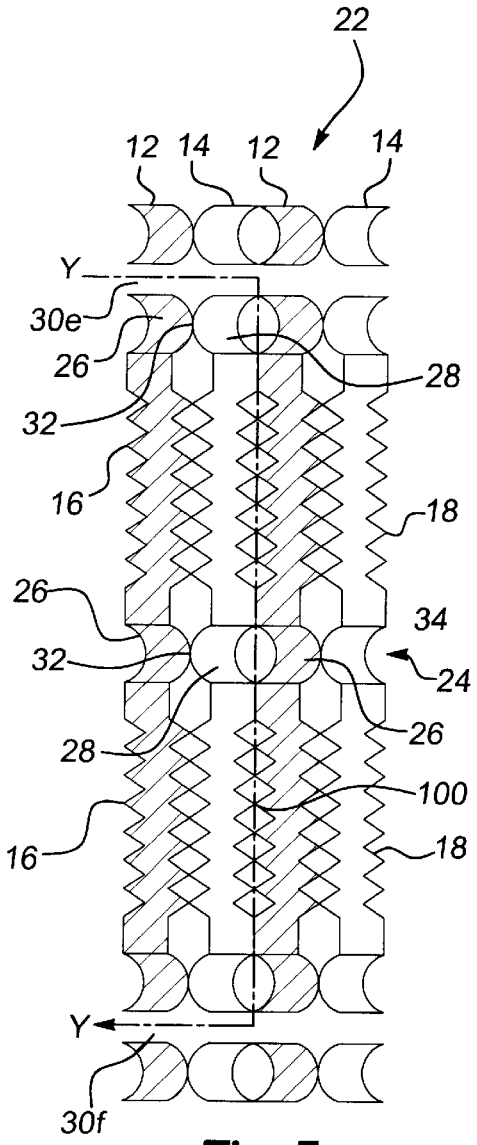
FIG. 7 illustrates a cross-sectional side view of the plate heat exchanger taken along line 7—7 of FIG. 5 showing the heat transfer fluid flow.

As illustrated in FIGS. 6 and 7, each plate 12, 14 includes a plurality of recessed areas 26 recessed to a depth equal to the height of the chevrons 16, 18, and a plurality of elevated areas 28 elevated to a height equal to the height of the chevrons 16, 18. If a recessed area 26 is placed on top of an elevated area 28, a seal 32 is formed such that the refrigerant streams and the heat transfer fluid streams are not allow to mix. Such a seal may be formed by methods such as brazing, welding, or the use of a gasket. If an elevated area 28 is placed on top of a recessed area 26, a flow passage 34 is created. The flow passages 34 create the refrigerant circuits A and B and the heat transfer fluid circuit Y. Each recessed area 26 and elevated area 28 further includes a hole 30 (illustrated in FIG. 5). Depending on the location, the holes 30 allow either refrigerant or heat transfer fluid to flow. When multiple plates are pressed together, holes 30 create a manifold for either the heat transfer fluid or for the refrigerant.

FIG. 6 illustrates the flow of refrigerant circuit A and refrigerant circuit B through the plate heat exchanger 22. Refrigerant enters circuit A through holes 30*a*. The refrigerant flows through flow passages 34, but is blocked by the seals 32. Refrigerant of circuit A exits the plate heat exchanger 22 through holes 30*b*. The flow of refrigerant through circuit B enters through holes 30*c* and exits through holes 30*d*. The refrigerant of circuits A and B are separated by circuit division 24. A seal 32 is created at the circuit division 24 by the elevated areas 28 and the recessed areas 26 to prevent the intermixing of the flows of refrigerant circuit A and refrigerant circuit B.

FIG. 7 illustrates the chilled heat transfer fluid flow of circuit Y. Chilled heat transfer fluid enters circuit Y through holes 30*e*. The heat transfer fluid flows through the flow passages 34, but is blocked by the seals 32. Heat transfer fluid of circuit Y exits through holes 30*f*. The flow of circuit Y is not blocked by circuit division 24 as a flow passage 34 is created. Therefore, the heat transfer fluid of circuit Y passes through the entire length of the plate heat exchanger 22. The heat transfer fluid and refrigerant circuits flow in alternate flow passages 34.

Figure 8:
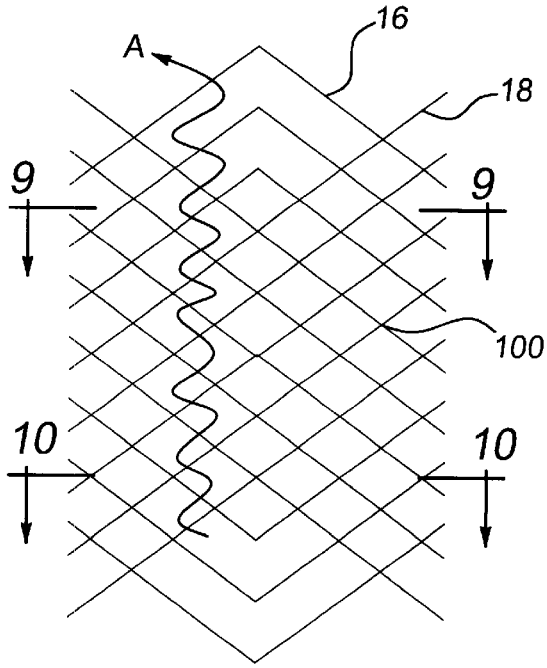
FIG. 8 illustrates a schematic view of the flow channels created by the plate heat exchanger.
Figure 9:
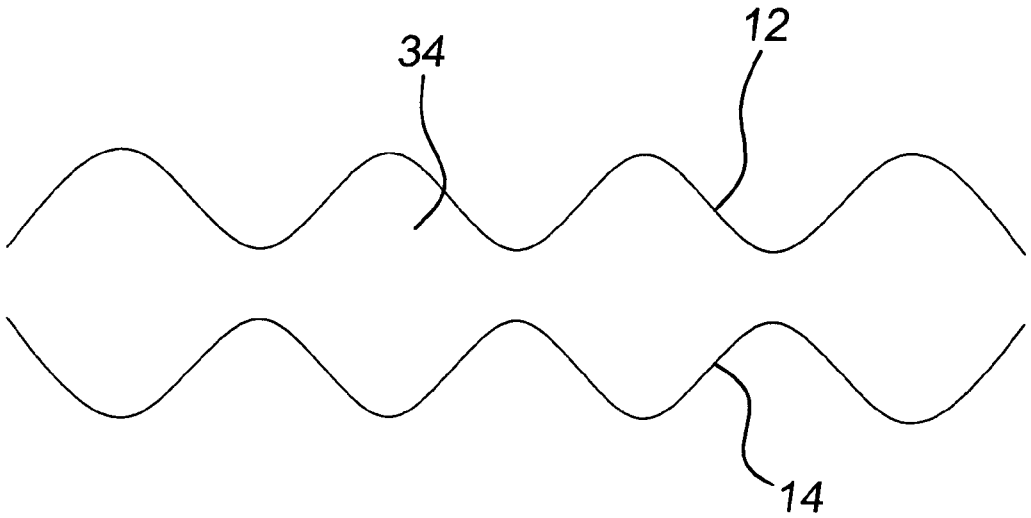
FIG. 9 illustrates a cross sectional view of the flow channels created by the plates.
Figure 10:
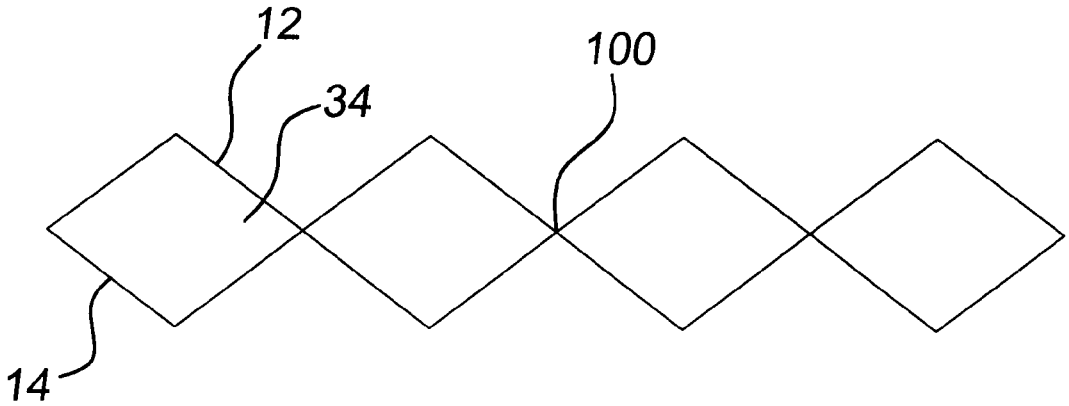
FIG. 10 illustrates a cross sectional view of the contact points of the plate heat exchanger.

FIG. 8 illustrates a schematic view of the chevrons 16, 18 of the plate heat exchanger 22. The chevrons 16, 18 are secured at points of contact 100, flow channels 34. FIGS. 9 and 10 illustrate the flow channel 34 and points of contact at various locations of the plate heat exchanger 22.

In the present invention, heat transfer fluid flows through circuit Y and exchanges heat first with refrigerant circuit A and then with refrigerant circuit B.

In a refrigeration cycle having two refrigerant circuits, the heat transfer surface areas of refrigerant circuit A and refrigerant circuit B in the present invention are substantially the same as the heat transfer surface areas of refrigerant circuit A and refrigerant circuit B in the prior plate heat exchanger. In the present invention, heat transfer fluid passes over the entire heat transfer surface area of refrigerant circuit A first, and then passes through the entire heat transfer surface area of refrigerant circuit B. In the prior design, refrigerant circuit A and refrigerant circuit B are arranged such that every heat transfer fluid channel exchanges heat with both refrigerant circuits simultaneously. The present invention can also be extended to a heat exchanger utilizing more than two refrigerant circuits. Although an evaporator has been illustrated and disclosed, a condenser can also be employed if the flows are reversed.

The refrigerant circuits can be organized in several manners. In one embodiment, refrigerant circuit A exchanges heat with the entering heat exchange fluid of both an evaporator and a condenser. In another embodiment, refrigerant circuit A exchanges heat with the entering heat exchange fluid of the evaporator and the leaving heat exchanger fluid of the condenser. It is also possible to combine the multiple circuit heat exchanger of the present invention with a prior art heat exchanger. In all of these embodiments, refrigerant circuit B would exchange heat with the remaining heat exchange fluid portion.

There are several advantages to utilizing the multiple refrigerant circuit heat exchanger of the present invention. By employing a single heat transfer fluid circuit, the average leaving temperature difference of each refrigerant circuit is reduced, reducing entropy generation and resulting in fewer thermodynamic losses. Additionally, there is a reduction in compressor lift (difference between the saturated discharge temperature and the saturated suction temperature for the compressor). This results in a reduction of the consumption of power, which improves the coefficient of performance of the refrigerant cycle.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A plate heat exchanger comprising:

a plurality of refrigerant circuits each containing a refrigerant;

a stream of heat transfer fluid passing once through each circuit and exchanging heat with each of said plurality of refrigerant circuits consecutively, said stream of heat transfer fluid traveling between said plurality of refrigerant circuits through a connector; and said plate heat exchanger is formed by a plurality of alternating first plates and second plates, said plurality of plates creating a plurality of heat transfer fluid passages containing said stream of heat transfer fluid and a plurality of refrigerant passages containing said refrigerant and said plurality of heat transfer passages and said plurality of refrigerant passages alternate and exchange heat therebetween, and said plurality of heat transfer fluid passages and said plurality of refrigerant passages extend substantially down a length of said heat exchanger, said plurality of refrigerant passages being interrupted by at least one divider to separate said plurality of refrigerant passages into said plurality of refrigerant circuits.

2. The plate heat exchanger as recited in claim 1 wherein an indent in said first plate substantially contacts an indent in said second plate to create said at least one divider.

3. The plate heat exchanger as recited in claim 1 wherein said heat transfer fluid is water.

4. The plate heal exchanger as recited in claim 1 wherein said heat transfer fluid is brine.

5. The plate heat exchanger as recited in claim 1 wherein said heat exchanger is a condenser.

6. The plate heat exchanger as recited in claim 1 wherein said heat exchanger is an evaporator.

7. The plate heat exchanger as recited in claim 1 wherein said plurality of refrigerant circuits includes a first refrigerant circuit and a second refrigerant circuit each containing a refrigerant, and said stream of heat transfer fluid passing once through and exchanges heat with said first refrigerant circuit, travels through said connector, and then passes once through and exchanges heat with said second refrigerant circuit.

8. A refrigeration system comprising:

a compression device to compress a refrigerant to a high pressure;

a first plate heat exchanger including a plurality of alternating first plates and second plates creating a plurality or refrigerant passages being interrupted by at least one divider to separate said plurality of refrigerant passages into a plurality of refrigerant circuits each containing a refrigerant and a plurality of heat transfer fluid passages alternating with said plurality of refrigerant passages to contain a stream of heat transfer fluid which passes once through each of said plurality of refrigerant circuits and exchanges heat with each of said plurality of refrigerant circuits consecutively, and said stream of heat transfer fluid travels between each of said plurality of refrigerant circuits through a connector;

an expansion device for educing said refrigerant to a low pressure; and a second plate heat exchanger.

9. The refrigeration as recited in claim 8 wherein said second plate heat exchanger further includes a plurality of alternating first plates and second plates creating a plurality of refrigerant passages being interrupted by at least one divider to separate said plurality of refrigerant passages into a plurality of refrigerant circuits, one of said plurality of refrigerant circuits containing said refrigerant and the other of said plurality of refrigerant circuits each containing a further refrigerant of a further compressor, and a plurality of heat transfer fluid passages alternating with said plurality of refrigerant passages to contain a stream of heat transfer fluid which passes once through each of said plurality of refrigerant circuits and travels between each of said plurality of refrigerant circuits through a connector, said refrigerant and said stream of heat transfer fluid exchanging heat therebetween.

10. The refrigeration as recited in claim 8 wherein said first plate heat exchanger is an evaporator and said second heat exchanger is a condenser.

11. The refrigeration as recited in claim 8 wherein said first plate heat exchanger is a condenser and said second heat exchanger is an evaporator.

12. A refrigeration system comprising:

a first and a second compression device to compress a first and a second refrigerant, respectively, to a high pressure;

a first plate heat exchanger including a plurality of alternating first plates and second plates creating a plurality of refrigerant passages being interrupted by a divider to separate said plurality of refrigerant passages into a first and a second refrigerant circuit, said first refrigerant circuit containing said first refrigerant and said second refrigerant circuit containing said second refrigerant, and a plurality of heat transfer fluid passages alternating with said plurality of refrigerant passages to contain a stream of heat transfer fluid which passes once through each of said plurality of refrigerant circuits and exchanges heat with each of said first and said second refrigerant circuit consecutively, said stream of heat transfer fluid travels between said first and said second refrigerant circuits through a connector;

a first and a second expansion device to reduce said first and said second refrigerant, respectively, to a low pressure; and a second plate heat exchanger.

13. The refrigeration system as recited in claim 12 wherein said second plate heat exchanger further includes a plurality of alternating first plates and second plates creating a plurality of refrigerant passages being interrupted by a divider to separate said plurality of refrigerant passages into said first and said second refrigerant circuits, and a plurality of heat transfer fluid passages alternating with said plurality of refrigerant passages to contain a stream of heat transfer fluid which passes once through and exchanges heat with each of said first and second refrigerant circuits.

* * * * *

UNITED STATES PATENT AND TRADEMARK OFFICE

CERTIFICATE OF CORRECTION

PATENT NO. : 6,502,420 B2
APPLICATION NO. : 09/871181
DATED : January 7, 2003
INVENTOR(S) : Gupte It is certified that error appears in the above-identified patent and that said Letters Patent is hereby corrected as shown below:

IN THE CLAIMS:

Claim 8 should read as follows:

-- 8. A refrigeration system comprising:
a compression device to compress a refrigerant to a high pressure;
a first plate heat exchanger including a plurality of refrigerant circuits each containing a refrigerant, a stream of heat transfer fluid passing once through each circuit and exchanging heat with each of said plurality of refrigerant circuits consecutively, said stream of heat transfer fluid traveling between said plurality of refrigerant circuits through a connector; and said first plate heat exchanger is formed by a plurality of alternating first plates and second plates, said plurality of plates creating a plurality of heat transfer fluid passages containing said stream of heat transfer fluid and a plurality of refrigerant passages containing said refrigerant and said plurality of heat transfer passages and said plurality of refrigerant passages alternate and exchange heat therebetween, and said plurality of heat transfer fluid passages and said plurality of refrigerant passages extend substantially down a length of said heat exchanger, said plurality of refrigerant passages being interrupted by at least one divider to separate said plurality of refrigerant passages Into said plurality of refrigerant circuits;
an expansion device for reducing said refrigerant to a low pressure; and
a second plate heat exchanger.

In Claim 8, Column 6, Line 28 of the patent, “educing” should be --reducing--.

Claim 12 should read as follows:

-- 12. A refrigeration system comprising:
a first and a second compression device to compress a first and a second refrigerant, respectively, to a high pressure;

UNITED STATES PATENT AND TRADEMARK OFFICE

CERTIFICATE OF CORRECTION

PATENT NO. : 6,502,420 B2
APPLICATION NO. : 09/871181
DATED : January 7, 2003
INVENTOR(S) : Gupte It is certified that error appears in the above-identified patent and that said Letters Patent is hereby corrected as shown below:

Claim 12, (cont'd)

a first plate heat exchanger including a plurality of refrigerant circuits each containing a refrigerant, a stream of heat transfer fluid passing once through each circuit and exchanging heat with each of said plurality of refrigerant circuits consecutively, said stream of heat transfer fluid traveling between said plurality of refrigerant circuits through a connector; and said first plate heat exchanger is formed by a plurality of alternating first plates and second plates, said plurality of plates creating a plurality of heat transfer fluid passages containing said stream of heat transfer fluid and a plurality of refrigerant passages containing said refrigerant and said plurality of heat transfer passages and said plurality of refrigerant passages alternate and exchange heat therebetween, and said plurality of heat transfer fluid passages and said plurality of refrigerant passages extend substantially down a length of said heat exchanger, said plurality of refrigerant passages being interrupted by at least one divider to separate said plurality of refrigerant passages into said plurality of refrigerant circuits;

a first and a second expansion device to reduce said first and said second refrigerant, respectively, to a low pressure; and a second plate heat exchanger.

Signed and Sealed this

Third Day of April, 2007

JON W. DUDAS
*Director of the United States Patent and Trademark Office*